US005233734A

United States Patent [19]

Strudel et al.

[11] Patent Number: 5,233,734

[45] Date of Patent: Aug. 10, 1993

[54] CIRCULAR SPREADER WITH A LOCKING MECHANISM FOR KEEPING THE SPREADER IN A SPREAD CONDITION

[75] Inventors: Werner Strudel, Friedrichshafen; Walter Miotke, Wangen, both of Fed. Rep. of Germany

[73] Assignee: Lindauer Dornier Gesellschaft m.b.H., Lindau, Fed. Rep. of Germany

[21] Appl. No.: 850,585

[22] Filed: Mar. 13, 1992

[30] Foreign Application Priority Data

Mar. 14, 1991 [DE] Fed. Rep. of Germany ..... 4108191

[51] Int. Cl.[5] ..... D06C 5/00

[52] U.S. Cl. ..... 26/80; 26/85

[58] Field of Search ..... 26/80, 82, 83, 84, 85, 26/71, 51

[56] References Cited

U.S. PATENT DOCUMENTS

| | | | |
|---|---|---|---|
| 1,280,607 | 10/1978 | Widdowson | 26/85 |
| 3,204,317 | 9/1965 | Hurt et al. | 26/84 |
| 3,370,116 | 2/1968 | Wrede | 26/84 |
| 3,479,706 | 11/1969 | Catallo | 26/83 |
| 4,306,341 | 12/1981 | Rottensteiner | 26/85 |
| 4,885,826 | 12/1989 | Strudel | 26/80 |
| 4,947,529 | 8/1990 | Strudel | 26/83 |
| 5,077,873 | 1/1992 | Strudel | 26/80 |

FOREIGN PATENT DOCUMENTS

| | | | |
|---|---|---|---|
| 638754 | 11/1936 | Fed. Rep. of Germany | 26/55 |
| 2117526 | 10/1972 | Fed. Rep. of Germany . | |
| 3732754 | 9/1987 | Fed. Rep. of Germany . | |
| 2467905 | 5/1981 | France | 26/84 |
| 1971 | 11/1968 | Japan | 26/83 |
| 2059477 | 4/1981 | United Kingdom | 26/84 |

*Primary Examiner*—Clifford D. Crowder
*Assistant Examiner*—Amy Brooke Vanatta
*Attorney, Agent, or Firm*—W. G. Fasse

[57] ABSTRACT

Circular spreaders for tubular textile goods make it necessary to keep the spreader arms in a desired spread-out condition so that an unintended reduction in the diameter of the circular spreader is prevented. Such unintended reduction could be caused by operational vibrations or by impacts to which the spreader may be exposed during operation. For this purpose the spreader is equipped with a locking mechanism which, on the one hand, permits a continuous adjustment or a stepwise adjustment of the circular spreader to a maximum spread diameter and which, on the other hand, prevents a reduction of the once adjusted spreader diameter. A ratchet mechanism is provided for this purpose.

8 Claims, 9 Drawing Sheets

CIRCULAR SPREADER WITH A LOCKING MECHANISM FOR KEEPING THE SPREADER IN A SPREAD CONDITION

FIELD OF THE INVENTION

The invention relates to spreader equipped with a locking mechanism for keeping the spreader in a spread condition. Such spreaders hold tubular textile goods in a spread condition. For this purpose a spreader of this type includes a plurality of spreader or support arms pivoted at their radially inner end to a central support shaft and holding at their outer ends longitudinal guide elements for guiding the tubular fabric.

BACKGROUND INFORMATION

U.S. Pat. No. 4,885,826 (Strudel), filed Sep. 29, 1988, and corresponding to German Patent 3,732,754 discloses a circular spreader for tubular textile fabric in which the central support shaft comprises two sections capable of telescoping relative to each other. A clamping mechanism is arranged inside the telesscoping sections of the spreader. The clamping mechanism is rigidly connected with the inner tubular section of the central support shaft on the one hand, and connectable in a force and form locking manner with the inside of the outer tubular section of the central support shaft. The clamping mechanism includes a clamping device that is connected to a connecting element with the upper bearing or support section of the head portion of the circular spreader. Thus, when the two tubular sections of the central support shaft are pulled apart in the axial direction, the clamping device is activated in such a manner that a further pulling apart of the tubular sections forming the central support shaft is prevented under normal operating conditions.

Such a clamping device, however, leaves room for improvement, especially with regard to providing an operational stability even under adverse operating conditions, for example, when uneven characteristics of the tubular fabric, such as a seam, expose the circular spreader to vibrations or even shocks. Such vibrations and/or shocks or impacts can temporarily reduce or even eliminate the frictional contact between the clamping components of the clamping device on the inner surface of the inner tubular section of the central support shafts. As a result, pressure spots may be formed in the tubular fabric by the position maintaining rollers of the roller heads. Such pressure spots reduce the quality of the tubular fabric. The position of the clamping device inside the tubular sections of the central support shaft also leaves room for improvement, because such a location of the clamping device does not facilitate the inspection and maintainence of the clamping device. Thus, when the clamping device needs to be repaired, the entire circular spreader must be taken apart.

OBJECTS OF THE INVENTION

In view of the above it is the aim of the invention to achieve the following objects singly or in combination:

- to provide a locking mechanism for an externally supported circular spreader for tubular fabric, which is more easily accessible and which will keep the spreader in its spread-out condition even when the spreader is exposed to vibrations or impacts during operation;

- the locking mechanism shall be adjustable for keeping the spreader in any desired spread-out condition at different spread-out diameters;
- to construct the locking mechanism in such a way that the adjustment of the spreader diameter is possible radially outwardly substantially continuously or in small incremental steps; and
- to make sure that an adjustment radially inwardly is possible only by an intentional manipulation, but prevented in response to vibrations or impacts.

SUMMARY OF THE INVENTION

The locking mechanism according to the invention is characterized by the following features. The outer surface of an inner telescoping member is provided with catch elements having a frustum-shaped cross-section and arranged one after the other along the inner telescoping member. The outer telescoping tubular member is provided with ratchet pawls tiltably secured to the free end of the outer telescoping member for cooperation with any one of the catch elements. The catch elements and the ratchet pawls cooperate with each other providing a positive force and form a locking engagement between the telescoping members forming the central support shaft of the circular spreader. The outer shaft member or section is tubular, but the inner shaft member or section may be tubular or it may be a rod carrying the catch elements in both instances. The intermeshing teeth engagement makes it possible to adjust the outer diameter radially outwardly from its smallest possible diameter to its largest possible diameter substantially in a continuous manner or in defined small incremetal steps determined by the size of the teeth or catch elements.

The just mentioned adjustment is possible, since the ratchet pawls and the catch elements cooperate in a ratchet manner. When unlocked, the inner shaft section moves into the outer shaft section and the spreader arms move radially outwardly for increasing the spreader diameter as will be described in more detail below. In the locked state, it is not possible to accidentally adjust the spreader arms from a large outer diameter to a small outer diameter due to the force and form locking engagement of the ratchet pawls with the catch elements which face the ratchet pawls in a mirror-symmetrical manner so that the pawls engage recesses or vice versa. Thus, these ratchet pawls completely prevent an accidental diameter reduction which is not assured in the prior art.

In order to permit an intentional release of the locking mechanism by permitting the ratchet pawls to disengage from the catch elements, a release mechanism is provided which includes a pulling or tension cable for each ratchet pawl. One end of each cable is connected to the respective ratchet pawl and the other end of the cable runs over a guide pully or sheave to a tensioning plate to which the pull cable is secured. The tensioning plate is arranged in the area of the spreader head. The tensioning plate on its part is connected at its center with a connecting piece into which a threaded rod is screwed. The threaded rod is indirectly connected through a further tensioning cable or directly with the head portion of the spreader. If now a tensining force is applied to the first mentioned tensioning cable the respective ratchet pawl is pulled out of engagement with the catch elements. As a result, the inner shaft section or member is now freely movable relative to the outer shaft tubular member or section or vice versa. As a result, the spreader arms can now be tilted inwardly to reduce a larger spreader diameter to a smaller spreader diameter.

The inward folding is basically the same as in the above mentioned U.S. Pat. No. 4,885,826, whereby the entire head section of the spreader can be lifted or lowered by means of a corresponding mechanism. The threaded rod or the second tension cable that extends the threading rod, is connected to an upper bearing or support which is connected through a longitudinal adjustable connecting element to the head section of the spreader. For this purpose the threaded rod or the further tension cable is connected with the connecting piece. The connection with the head section is accomplished through a head frame of the spreader.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Referring first to FIGS. 1 to 5, the circular spreader 1 comprises two telescoping central support sections 2 and 3 forming a support shaft. Preferably, each support section 2 and 3 is constructed as a tubular member, however, the inner tubular member may instead be constructed as a rod. In any event, the inner shaft section 3 slides with its small outer diameter inside the tubular shaft section 2 having a larger inner diameter to permit a sliding fit between the inner shaft section 3 inside the outer shaft section 2.

Figure 1:
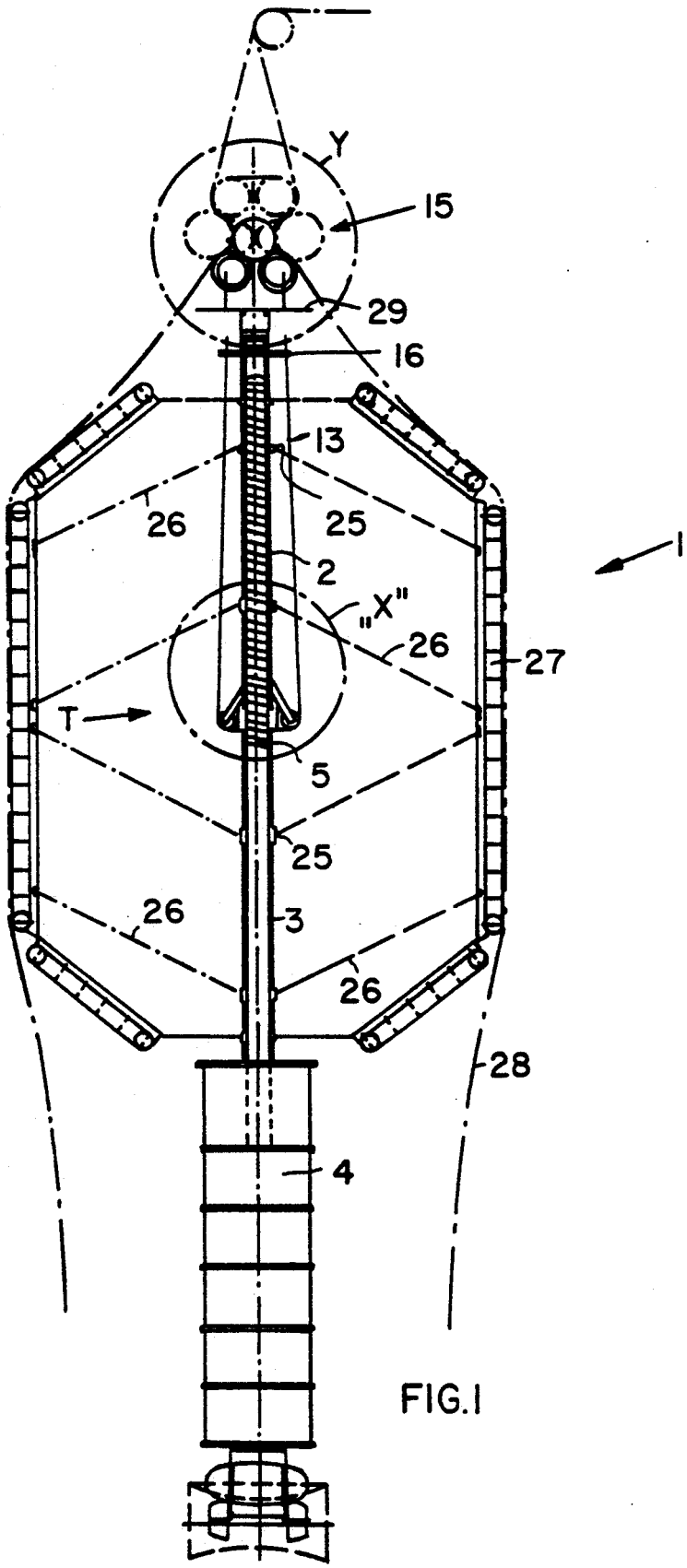
FIG. 1 is a side view of the circular spreader in its maximally expanded position, whereby it has its largest diameter.
Figure 2:
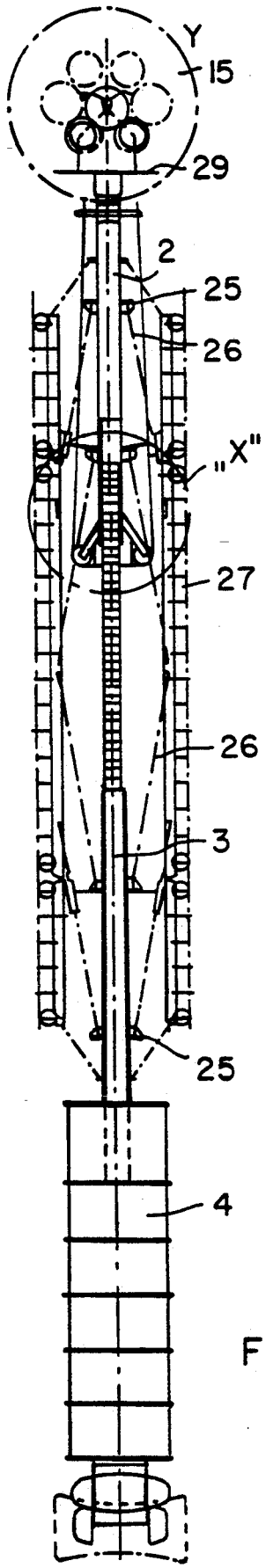
FIG. 2 is a view similar to that of FIG. 1, but showing the spreader when it has its minimal diameter.

The lower end of the inner shaft section 3 is connected to a floating body 4 as shown in FIGS. 1 and 2. According to the invention the outer surface of the support shaft section 3 is provided with catch elements 5 which begin at the free end of the section 3 and follow each other along a certain length of the section 3. The catch elements 5 have a frustum cross-sectional shape and preferably extend all around the section 3. These catch elements 5 form ratchet teeth. The catch elements 5 cooperate with ratchet pawls 6 which, in their intermeshing position with the catch elements 5, connect the lower shaft section 3 with the upper shaft section 2. For operating, the ratchet pawls 6 are pivoted at their upper end to the section 2 in such a way that tension springs 7 bias the ratchet pawls 6 to engage the catch elements 5 in a force and form locking manner.

The number of catch elements 5 along the length of the shaft section 3, will at least be such that the entire length of the catch elements 5 will permit adjusting the spreader to its maximum diameter.

Figure 3:
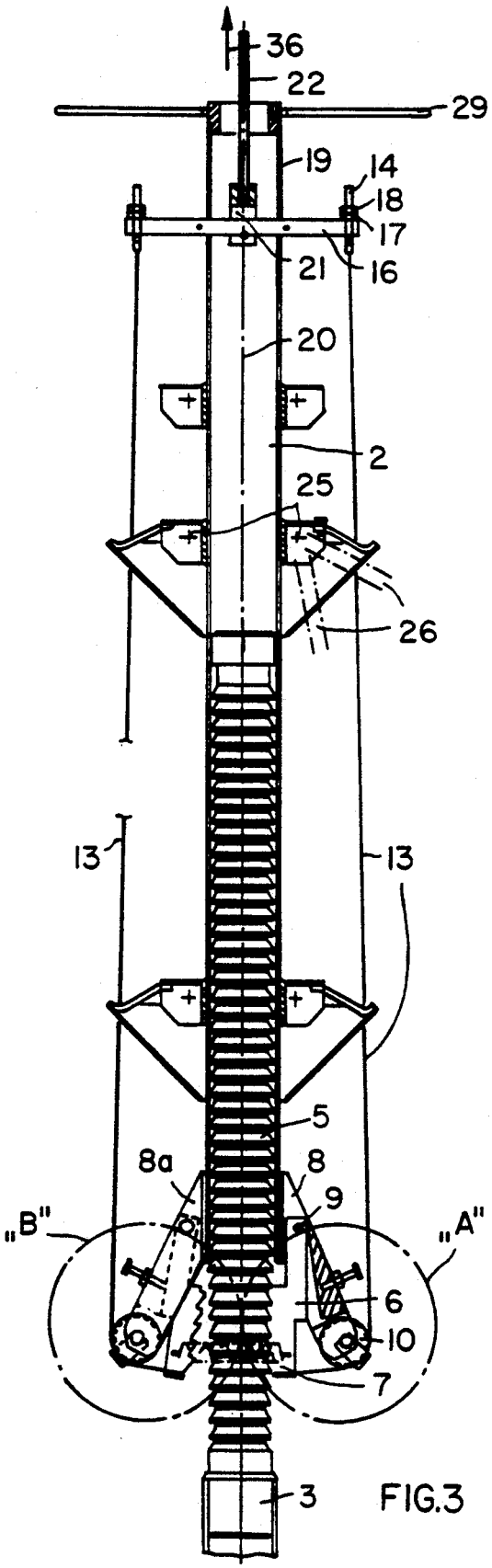
FIG. 3 illustrates the central support shaft of the circular spreader with the locking mechanism T according to the invention, whereby the right-hand detail A shows the locking mechanism in its locked position, and whereby the left-hand detail B shows the locking mechanism in its unlocked condition.

As shown in FIG. 3, the upper end of each pawl 6 is pivoted at a pivot junction 9 to a bracket 8 rigidly connected to the free end of the support section 2. Each bracket 8 carries at its lower free end a rotatably supported guide roller 10. The brackets 8 carrying the respective pawl 6 enclose an angle $\alpha$ shown in FIGS. 4 and 5 with the vertical longitudinal central axis 20 of the support shaft 2, 3. The angle $\alpha$ opens downwardly toward the floating body 4. The two pairs of brackets 8, 8 and 8*a*, 8*a* are spaced from one another, on center, by 180° around the central support shaft. Instead of using two pairs of brackets 8, 8*a*, it is possible to use more such brackets and correspondingly more pawls 6. For example, four sets could be used angularly spaced by 90° from one another. The catch elements 5 can cooperate with any suitable number of pawls 6. A larger number of pawls provides a more symmetric force distribution with regard to the catch elements 5 around the central support shaft 2, 3.

Figure 4:
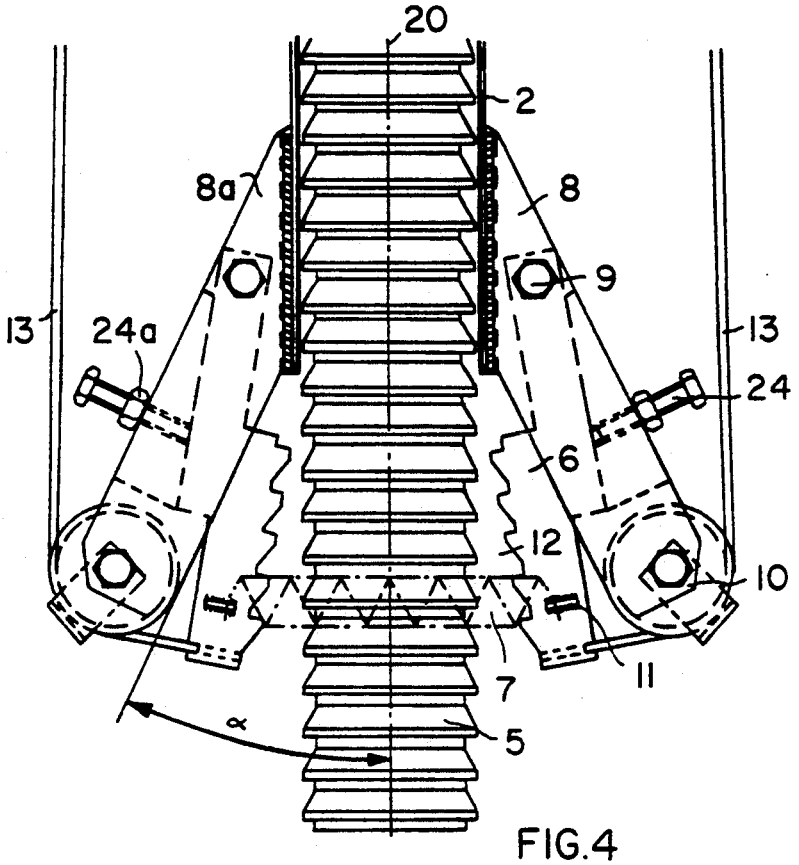
FIG. 4 illustrates the detail B of the locking mechanism as shown in FIG. 3.
Figure 5:
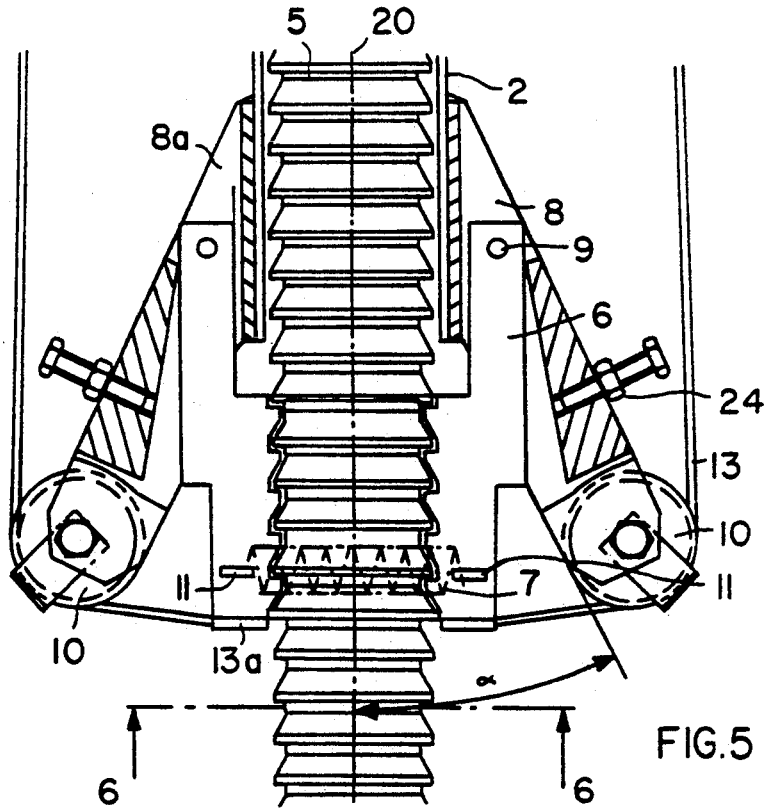
FIG. 5 shows the detail A of the locking mechanism according to FIG. 3.
Figure 6:
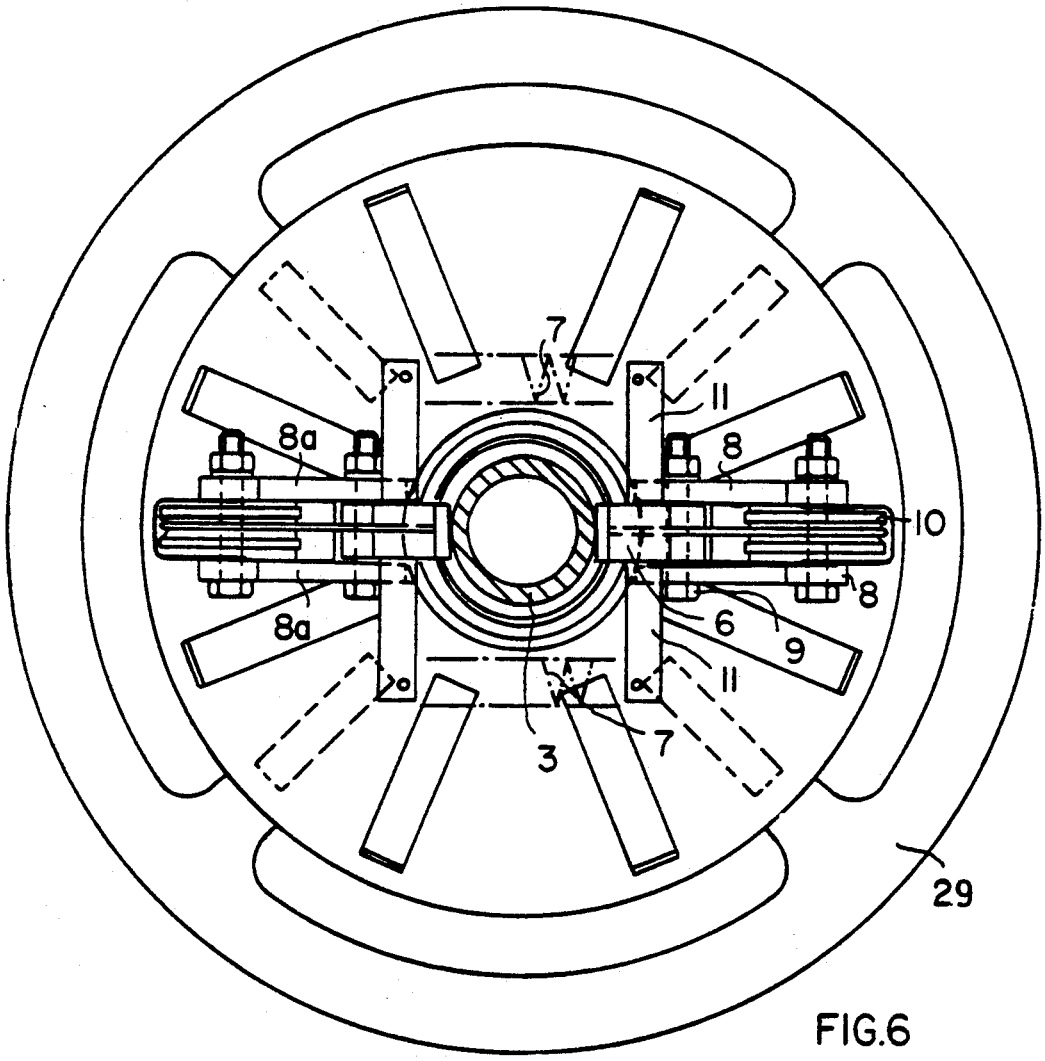
FIG. 6 is a view in the direction of the section plane indicated by arrows 6—6 in FIG. 5.

As shown in FIGS. 4, 5, and 6, a pull arm 11 is rigidly secured to each side of the ratchet pawls 6, for example, by welding. Each pull arm 11 is longer than the radius of the central support shaft. The outer free ends of the arms 11 are interconnected by tension springs 7 which bias the pawls 6 into engagement with the catch elements 5 as shown in FIG. 5. In FIG. 4 the pawls 6 are pulled apart against the tension of the springs 7. In the position shown in FIG. 5, the teeth of the pawls engage the teeth formed by the catch elements 5 in a form locking and force locking manner.

The downwardly facing free end of each pawl 6 is secured at 13*a* to a tension cable 13 running over a guide roller 10 rotatably mounted on the respective bracket 8, 8*a*. Thus, the connecting point 13*a* of each pawl 6 is located opposite the pivot junction 9 of the respective pawl 6. As seen in FIG. 3, the other end of each tension cable or pull cable 13 is secured to a tension plate 16 by means of an adjustable threaded screw 14 secured by a nut 17 and a counternut 18. The tension plate 16 in turn passes through a slot 19 in the upper tubular shaft section 2 near the head section 15 of the circular spreader 1. The tension plate 16 is centrally held by an intermediate piece 21 which in turn is connected to a threaded rod 22. By operating the threaded rod 22 the tensioning plate can be raised or lowered for causing the engagement or disengagement of the pawls 6 with the catch elements 5. The adjustment range of the tensioning plate 16 is determined by the axial length of the slots 19.

Figure 7:
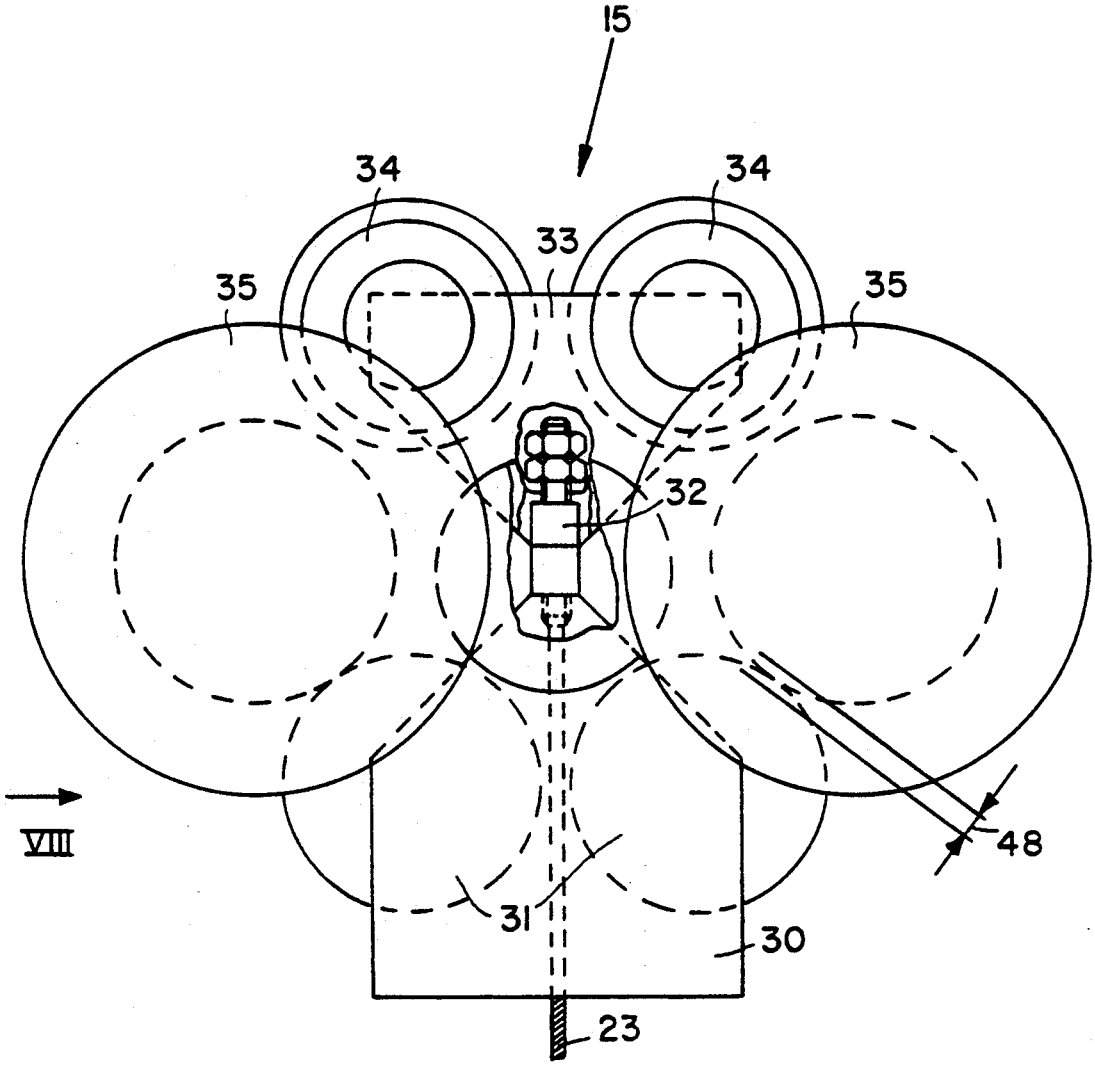
FIG. 7 is a side view of the head section showing the detail Y on an enlarged scale according to FIG. 1 when the locking mechanism is in its locked condition.

The threaded rod 22 in turn is connected to the head portion 15 of the spreader 1 in an operative manner either directly by engaging into a threaded member in the head section 15 or indirectly through a further tension cable 23 shown in FIG. 7.

The brackets 8, 8*a* are provided with adjustment screws 24 cooperating with counternuts 24*a* for limiting the outward tilting movement of the pawls 6. In FIG. 4 the pawls engage the stop or limit screws 24, when the locking mechanism is unlocked.

FIGS. 1 and 2 further show that the structural features of the circular spreader 1 are determined by the presence of pivot or journal points 25 secured to the central support shaft sections 2 and 3 for pivotally securing support or spreader arms 26 to the central shaft, whereby the radially inner ends of the arms 26 are pivoted to the respective pivot point 25 while the radially outer end of the respective arm is pivoted to roller segments 27. The tubular fabric 28 travels along the radially outwardly facing surface of the roller segments 27, whereby the fabric may travel either upwardly or downwardly. In FIG. 1 it is assumed that the fabric 28 travels downwardly.

The upper axially facing end of the outer tubular shaft section 2 is connected to a plate 29 best seen in FIG. 3. The plate 29 supports the spreader head section 15 as seen in FIGS. 1 and 2. The head section 15 is rigidly secured to the plate 29.

Figure 8:
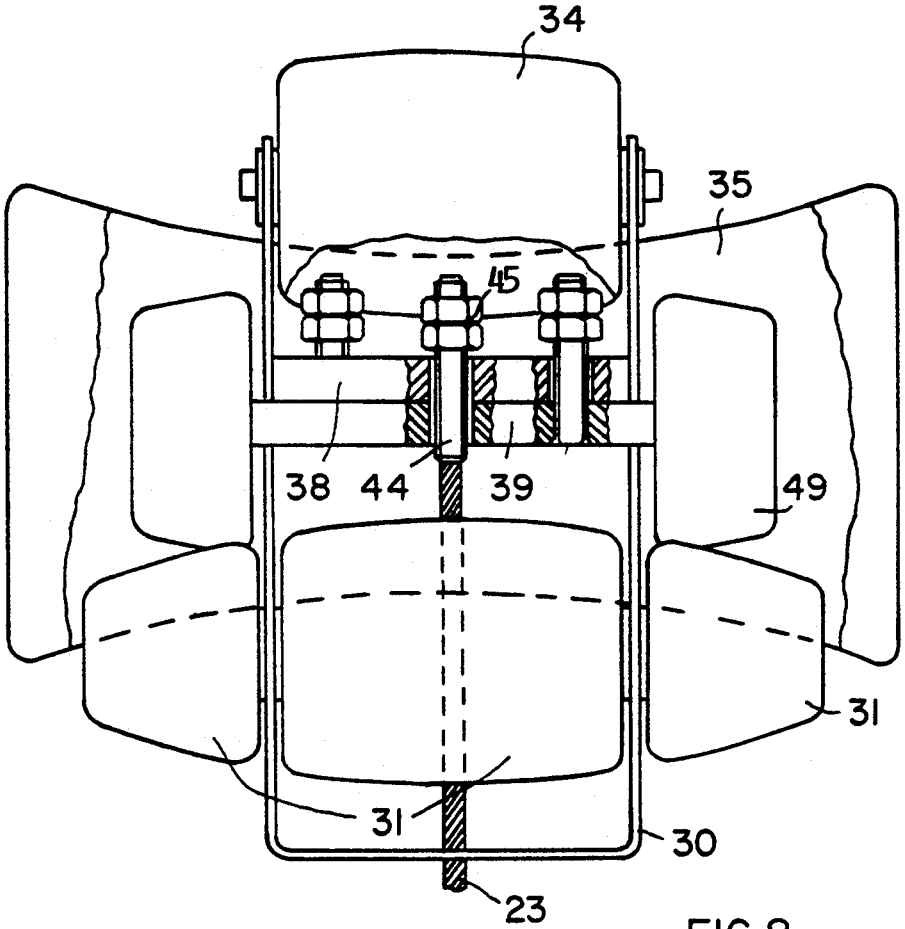
FIG. 8 is a view in the direction of the arrow C shown in FIG. 7.
Figure 9:
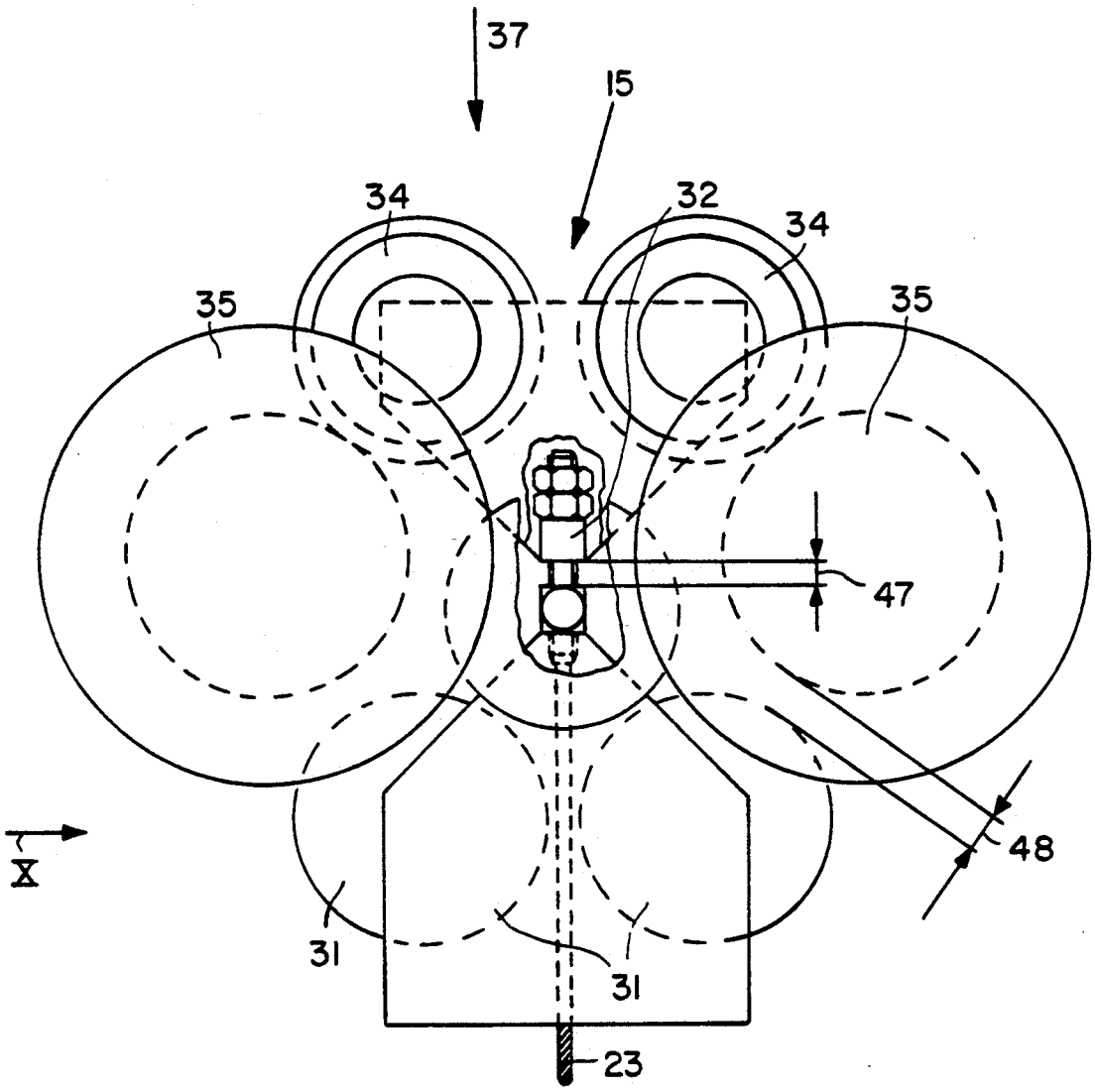
FIG. 9 is a side view of the head section of the spreader illustrating the detail Y of FIG. 1 when the locking mechanism is opened.

Referring to FIGS. 7, 8, and 9, the spreader head section 15 comprises a head frame 30 on which support rollers 31 are rotatably mounted.

The frame 30 further carries a longitudinally, or rather axially adjustable connecting device 32 which in turn supports an upper bearing section 33 carrying rotatably supported counter rollers 34. Spreader positioning rollers 35 are held rotatably on the head 15 by counter rollers 31 and 34. For this purpose, the positioning rollers 35 have a concave outer surface, while the counter rollers 31 and 34 have a convex surface. Thus, the rollers 31 and 34 provide a space between themselves in which the respective positioning roller 35 is received in a form locking manner.

The positioning rollers 35 are additionally supported on a shaft as described in U.S. Pat. No. 4,885,826. The respective shaft is mounted to the frame structure of the spreader by means of adjustable spindles so that the head frame 30 and the positioning rollers 35 are adjustable up and down in the longitudinal direction of the axis 20 of the spreader. Arrow 36 in FIG. 3 and arrow 37 in FIG. 9 indicate the axial adjustment of the entire head section 15 in the axial direction up or down for adjusting the diameter of the circular spreader 1.

Referring to FIGS. 3 and 5, the unlocking of the lower shaft section 3 from the upper shaft section 2 will now be described. If an axial pulling force is applied upwardly to the rod 22 as indicated by the arrow 36, the pawls 6 are tilted radially outwardly about the respective pivot junction 9 through the tensioning plate 16 and the respective pulling cable 13 running over the corresponding guide roller 10, whereby the pawls 6 are disengaged from the catch elements 5. As mentioned, the radial outward tilting of the pawls 6 is limited by the adjustable stop screws 24. Simultaneously, the tension springs 7, which interconnect two pawls 6 located opposite each other, are tensioned to provide the pawls 6 with a bias tending to engage the teeth of the pawls 6 with the catch elements 5. Thus, when the tensioning force or pulling force through the cables 13 is released, the lock engagement will automatically be enforced by the springs 7. As long as the pulling force on the rod 22 and cable 13 exceeds the force of the spring 7, the mechanism is unlocked.

Referring to FIGS. 7, 8, 9, and 10, the connection and cooperation of the tension or pulling cable 23 with the head section 15 will now be described. The pulling cable 23 is connected with the rod 22 that is threaded into the connecting piece 21 which in turn is connected to the tensioning plate 16. The second pulling cable 23 extends through the head frame 30 and one end of the cable 23 is secured to a connecting device 32 which is axially adjustable by a threaded member 44 and nuts 45 shown, for example, in FIGS. 8 and 10.

A plate 38 with side arms forms a bearing or mounting yoke 33 for supporting the counter rollers 34. The yoke 33 forms part of the head frame 30. The counter rollers 34 are rotatably supported in the U-profile of the yoke 33.

The lower portion of the head frame 30 also forms a U-configuration in which the support rollers 31 are rotatably mounted. The head frame 30 also comprises a cross piece 39 forming a stop member to which the plate 38 is mounted through the above mentioned longitudinally adjustable connecting device 32.

The connecting device 32 comprises substantially two guide bolts 40 arranged in parallel to one another. The guide bolts 40 pass through a respective bore 41 in the upper plate 38 and are welded with their head end or bolt end to the cross or stop piece 39 forming part of the lower portion of the head frame 30. The adjustment of the nuts 42 on the threaded end of the bolt 40 can thus determine the spacing between the plate 38 and the cross piece 39.

The tension cable 23 is rigidly connected with its upper end with the bolt or head end of the threaded bolt 43 which passes through a throughbore 44 into the lower cross piece 39. The threaded bolt 43 passes through a through bore 46 in the upper plate 38 and is held in place by nuts 45. By adjusting these nuts 45 on the threaded bolt 43, the tension on the pull cable 23 can be adjusted.

Referring to FIGS. 7 and 9, the guide gaps for the tubular fabric 28 in the upper head section 15 will now be described in more detail. It is an important advantage of the locking mechanism according to the invention that the positioning roller 35 is prevented from pressing against the running surface of the support rollers 31. Such unpermissible pressing can cause squeeze marks on the tubular fabric 28. The invention avoids such squeeze marks because the present locking mechanism makes sure that a guide gap 48 will always have a defined width between the positioning roller 35 and the support rollers 31.

The gap 48 is shown in FIG. 9 and its illustration in FIG. 7 approximates zero since the rollers 31 and 35 are shown to lightly contact each other. In fact, these rollers do not contact each other and the gap 48 is always maintained to have a width corresponding to the thickness of the tubular fabric 28, whereby squeeze marks are positively avoided even in sensitive fabrics.

When the pawls 6 are disengaged from the catch elements 5 to permit a telescoping between the shaft sections 2 and 3, the gap 48 is relatively large between the running surfaces of the positioning rollers 35 and the support rollers 31. In this position, the cables 13 and 23 are under tension to open the pawls 6 and keep them open until the shaft sections 2 and 3 have been adjusted relative to each other.

Figure 10:
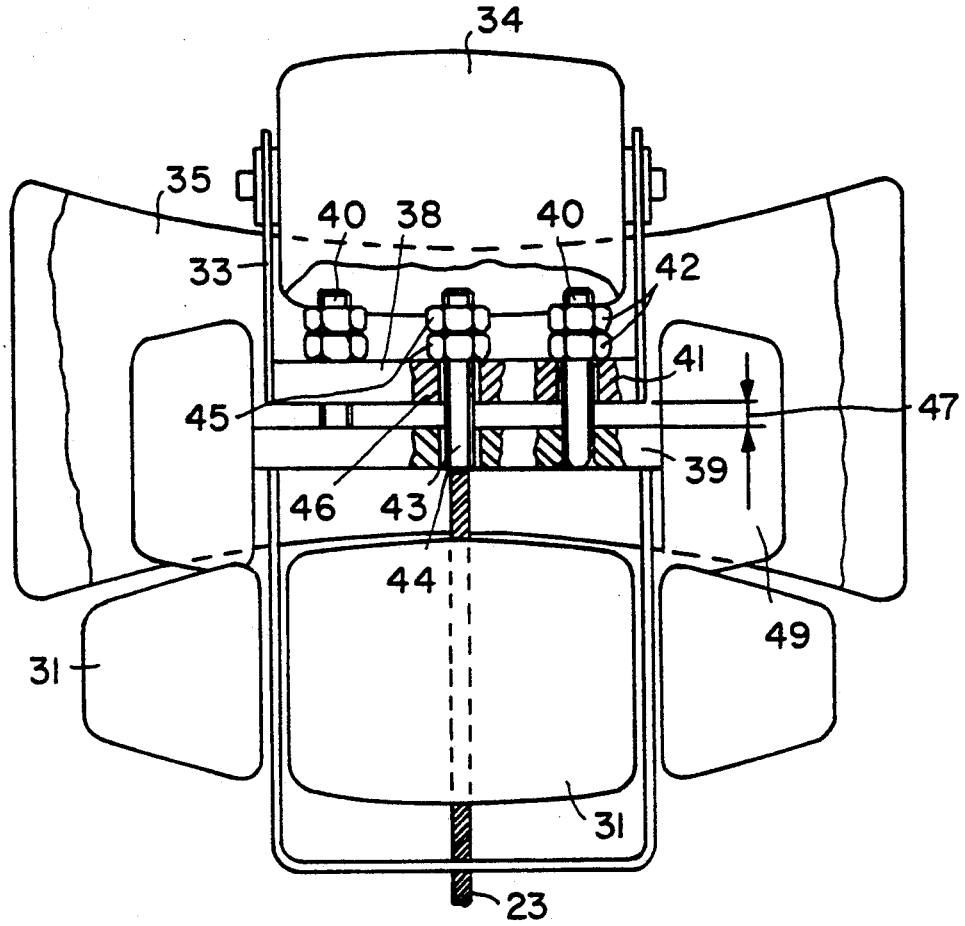
FIG. 10 is a view in the direction of the arrow D of the head section according to FIG. 9.

As soon as the end position of the desired adjustment is achieved, the adjustment drive for shifting the positioning rollers 35 upwardly in the direction of the arrow 36 is switched over briefly so that the entire drive moves downwardly for a short moment, whereby the connecting device 32 or rather the upper and lower frame sections, are moved toward each other to close the gap 47 as shown in FIGS. 9 and 10. In other words, the gap 47 disappears as shown in FIG. 7 so that the tension on the pull cables 13, 23 disappears and the pawls 6 assume their locking position shown in FIG. 5. Now a precise adjustment is made with the aid of the threaded bolt 40 and the nuts 42 so as to establish a precisely defined spacing between the plate 38 and the cross piece 39 forming part of the upper and lower head frame, as described above. This feature assures that the gap 48 between the running surface of the positioning roller 35 and the running surface of the support roller 31 is precisely adjusted in its gap width. This feature makes certain that unpermissible squeezing marks on the fabric 8 are prevented, even if the support arms 26 exert substantial forces for holding, or rather supporting the fabric.

The precisely defined gap 48 is always maintained when the locking mechanism has already assumed the position shown in FIG. 5. As a result, even substantial radially inwardly directed forces exerted by the fabric 28 on the support arms 26 cannot change the width of the gap 48, since in this position the two sections 2 and 3 are rigidly interlocked as shown in FIG. 5.

FIGS. 8 and 10 show further guide rollers 49 which are rotatably mounted to cross piece 39 and thus to the head frame 30. These guide rollers 49 have the purpose of preventing an unpermissible twisting of the tubular fabric 28 when the latter passes over the circular spreader. These additional guide rollers 49 form, so to speak, lateral stops for the fabric 28.

Although the invention has been described with reference to specific example embodiments, it will be appreciated that it is intended to cover all modifications and equivalents within the scope of the appended claims.

What we claim is:

1. A circular spreader for a tubular textile fabric, comprising a locking mechanism for keeping said spreader in a spread condition, a central support shaft, a plurality of spreader arms pivotally secured to said central support shaft, longitudinal support means mounted to said spreader arms for guiding said tubular textile fabric n a longitudinal travel direction along said spreader, said central support shaft comprising an inner shaft section (3) and an outer shaft section (2) telescoping relative to each other in a longitudinal direction defined by said central support shaft, said circular spreader further comprising at least a pair of spreader positioning rollers outside said tubular fabric and a pair of fabric support rollers inside said tubular fabric, said pair of fabric support rollers cooperating with said pair of spreader positioning rollers for holding said spreader in place inside said tubular textile fabric, said locking mechanism comprising means for cooperating with said two shaft sections of said central spreader support shaft, said cooperating means comprising a plurality of catch elements (5) arranged on an outer circumference of said inner shaft section (3) and ratchet pawl means (6) secured to a free end of said outer shaft section (2) for engaging said catch elements (5), whereby said two shaft sections are rigidly locked to each other by an engagement of said catch elements (5) with said ratchet pawl means (6) to maintain said spreader arms in a spread-out position up to a maximum spreader diameter, and biasing means (7) urging said ratchet pawl means (6) into engagement with said catch elements (5) for blocking an unintended return of said spreader arms into a position which would reduce an intended spreader diameter while permitting an intended adjustment of said spreader diameter.

2. The circular spreader of claim 1, wherein said catch elements (5) are arranged along an axial length of said inner shaft section (3) which length corresponds at least to a measure of a maximum radially outward spreader adjustment of said circular spreader.

3. The circular spreader of claim 1, further comprising bracket means (8) for securing said ratchet pawl means (6) to said free end of said outer shaft section (2), said bracket means (8) having a first end rigidly connected to said free end of said outer shaft section (2), said bracket means having a second end opposite said first end, and a guide roller (10) rotatably mounted to said second end of said bracket means (8).

4. The circular spreader of claim 3, wherein said bracket means (8) are arranged at an acute angle ($\alpha$) relative to a longitudinal axis (20) of said central support shaft, said angle ($\alpha$) opening in the direction of a floating body (4) of said circular spreader (1), and wherein said ratchet pawl means (6) are pivoted to said bracket means (8).

5. The circular spreader of claim 1, wherein said ratchet pawl means (6) comprise recesses (12) corresponding to said catch elements (5).

6. The circular spreader of claim 1, wherein said ratchet pawl means (6) for locking of said shaft sections (2, 3) to each other comprise a pull arm (11) on each side of each ratchet pawl means (6), and wherein said biasing means comprise tension spring means (7) interconnecting said pull arms (11) with each other to bias said ratchet pawl means into a locked position.

7. The circular spreader of claim 1, further comprising means for unlocking of said inner shaft section (3) from said outer shaft section (2), said unlocking means comprising a tension cable (13) connected at one cable end to each ratchet pawl means (6) for unbiasing said biasing means (7), said tension cable being guided around a guide roller (10) and connected with an upper support member of a spreader head section (15) through an intermediate member (21) and through a threaded rod 922) connected to a tensioning plate (16) for simultaneously unbiasing said ratchet pawl means (6).

8. The circular spreader of claim 1, wherein said catch elements (5) are arranged one next to the other along said inner shaft section (3), said catch elements (5) having a frustum-shaped sectional configuration, wherein said ratchet pawl means (6) are pivoted to a free end of said outer shaft section (2) for engaging said catch elements (5), and wherein said biasing means (7) cause a force- and form-locking engagement of said catch elements (5) with said ratchet pawl means (6) for preventing an unintended unlocking.

* * * * *